US009856101B2

(12) United States Patent
Mizuno

(10) Patent No.: US 9,856,101 B2
(45) Date of Patent: Jan. 2, 2018

(54) SHEET CONVEYING DEVICE AND IMAGE FORMING APPARATUS

(71) Applicant: Konica Minolta, Inc., Chiyoda-ku, Tokyo (JP)

(72) Inventor: Kyoichi Mizuno, Tama (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/804,647

(22) Filed: Jul. 21, 2015

(65) Prior Publication Data

US 2016/0023858 A1 Jan. 28, 2016

(30) Foreign Application Priority Data

Jul. 23, 2014 (JP) ..... 2014-149999

(51) Int. Cl.
*B65H 9/04* (2006.01)
*B65H 9/00* (2006.01)
(Continued)

(52) U.S. Cl.
CPC ..... *B65H 9/002* (2013.01); *B41J 13/0009* (2013.01); *B65H 5/068* (2013.01); *B65H 7/06* (2013.01); *B65H 7/20* (2013.01); *B65H 9/004* (2013.01); *B65H 9/006* (2013.01); *G03G 15/6567* (2013.01)

(58) Field of Classification Search
CPC ..... B65H 9/002; B65H 9/006
See application file for complete search history.

(56) References Cited

U.S. PATENT DOCUMENTS 7,986,912 B2 * 7/2011 Maruyama ..... G03G 15/6564 271/226
8,036,588 B2 * 10/2011 Ishida ..... G03G 15/6567 271/228

(Continued)

FOREIGN PATENT DOCUMENTS

JP 02198462 A 8/1990
JP 11020993 A 1/1999

(Continued)

OTHER PUBLICATIONS

Japanese Notice of Reasons for Rejection corresponding to Patent Application No. 2014-149999; dated Mar. 22, 2016, with English translation.

*Primary Examiner* — Luis A Gonzalez
(74) *Attorney, Agent, or Firm* — Cantor Colburn LLP

(57) ABSTRACT

A sheet conveying device includes: a skew detection section configured to detect a tilt of a sheet to be conveyed; two skew correction roller sections that are arranged side by side in a sheet width direction and are independently able to be driven; a downstream-side conveying roller section arranged at a downstream side of the skew correction roller sections in a sheet conveying direction; and a control section configured to control conveying operations of the skew correction roller sections based on a detection result of the skew detection section, wherein at least one of the skew correction roller sections is configured to be movable in the sheet width direction, and the control section moves at least one of the skew correction roller sections outward in the sheet width direction at predetermined timing.

11 Claims, 9 Drawing Sheets

(51) Int. Cl.

| | |
|---|---|
| ***B65H 7/06*** | (2006.01) |
| ***B65H 7/20*** | (2006.01) |
| ***B65H 5/06*** | (2006.01) |
| ***B41J 13/00*** | (2006.01) |
| ***G03G 15/00*** | (2006.01) |

(56) References Cited

U.S. PATENT DOCUMENTS

| | | | | |
|---|---|---|---|---|
| 8,382,105 | B2 * | 2/2013 | Compera | B65H 7/02 271/253 |
| 2012/0286468 | A1 * | 11/2012 | Ui | B65H 7/06 271/228 |

FOREIGN PATENT DOCUMENTS

| | | | |
|---|---|---|---|
| JP | 11208939 | A | 8/1999 |
| JP | 2000095384 | A | 4/2000 |
| JP | 2005154114 | A | 6/2005 |
| JP | 2008120561 | A | 5/2008 |
| JP | 2013067456 | A | 4/2013 |

* cited by examiner

SHEET CONVEYING DEVICE AND IMAGE FORMING APPARATUS

The present invention claims priority under 35 U.S.C. §119 to Japanese Application No. 2014-149999 filed on Jul. 23, 2014, the entire content of which is incorporated herein by reference.

BACKGROUND OF THE INVENTION

Field of the Invention

The present invention relates to a sheet conveying device and an image forming apparatus having a sheet skew correction function.

Description of the Related Art

Typically, in image forming apparatuses (a printer, a copying machine, a facsimile, and the like) using a electrophotographic process technology, a uniformly charged photosensitive member (for example, a photosensitive drum) is irradiated (exposed) with laser light based on image data, so that an electrostatic latent image is formed on a surface of the photosensitive member. Then, a toner is supplied to the photosensitive member on which the electrostatic latent image is formed, so that the electrostatic latent image is visualized and a toner image is formed. After the toner image directly transferred to a sheet, or indirectly transferred to a sheet through an intermediate transfer member, the toner image is heated and pressurized, so that an image is formed on the sheet.

Such image forming apparatuses include a sheet conveying section that conveys a sheet supplied from a sheet feeding section (a sheet feeding tray section, a manual feeding tray section, and the like) to an image forming section. The sheet conveying section includes a plurality of conveying roller sections such as a loop roller section and a registration roller section. It is known that, in the sheet conveying section, the sheet is conveyed in a tilted state (so-called skew), due to a slight tilt of a conveying roller axis or a difference of nip pressure (hereinafter, "conveyance nip pressure") among the conveying roller sections.

The skew of a sheet can be corrected such that two conveying roller sections (hereinafter, referred to as "skew correction roller sections"), which are independently driven, are arranged in parallel in a sheet width direction, and conveying speeds of the respective skew correction roller sections are differentiated (for example, JP 11-20993 A, JP 11-208939 A, and JP 2000-95384 A). Such technique is called active registration system.

For example, as illustrated in FIG. 1, a first loop roller section 31A and a second loop roller section 31B function as the skew correction roller sections. To be specific, the conveying speed of the skew correction roller section (the first loop roller section 31A in FIG. 1), to which the sheet enters first, is made slower than the conveying speed of the other skew correction roller section (the second loop roller section 31B in FIG. 1), so that the sheet is rotationally moved and the skew is corrected.

Further, in JP 11-20993 A and JP 11-208939 A, the conveying roller section arranged at an upper stream side of the skew correction roller sections in a sheet conveying direction is configured to be movable in the sheet width direction, so that the rotational movement of the sheet can be smoothly performed at the time of skew correction.

In a case of a tough sheet such as a cardboard, the skew of the sheet can be corrected without any problem by providing of a speed difference between the two skew correction roller sections. However, in a case of a weak sheet such as a thin paper, the sheet is pushed toward the sheet width direction mainly at a downstream side of the skew correction roller sections in the sheet conveying direction, as illustrated in FIG. 2, and a distortion extending in the sheet conveying direction may be caused (hereinafter, referred to as "loop distortion"). Even if the conveying roller section arranged at the upper steam side of the skew correction roller sections in the sheet conveying direction is moved in the sheet width direction, like JP 11-20993 A and JP 11-208939 A, the loop distortion caused at the downstream side of the skew correction roller sections in the sheet conveying direction cannot be removed.

When the sheet in a distorted state enters the conveying roller section (a registration roller section 32 in FIG. 2) at the downstream side in the sheet conveying direction and is nipped, wrinkles occur, and the quality of the image formed product is substantially deteriorated.

SUMMARY OF THE INVENTION

An object of the present invention is to provide a sheet conveying device that can prevent occurrence of wrinkles associated with skew correction of a sheet, and an image forming apparatus that can create a high-quality image formed product without wrinkles.

To achieve the abovementioned object, according to an aspect, a sheet conveying device reflecting one aspect of the present invention comprises: a skew detection section configured to detect a tilt of a conveyed sheet; two skew correction roller sections that are arranged side by side in a sheet width direction and are independently able to be driven; a downstream-side conveying roller section arranged at a downstream side of the skew correction roller sections in a sheet conveying direction; and a control section configured to control conveying operations of the skew correction roller sections based on a detection result of the skew detection section, wherein at least one of the skew correction roller sections is configured to be movable in the sheet width direction, and the control section moves at least one of the skew correction roller sections outward in the sheet width direction at predetermined timing.

An image forming apparatus according to an embodiment of the present invention preferably comprises: the sheet conveying device described above; and an image forming section configured to form an image on a sheet conveyed by the sheet conveying device.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described in detail with reference to the drawings. However, the scope of the invention is not limited to the illustrated examples.

Figure 3:
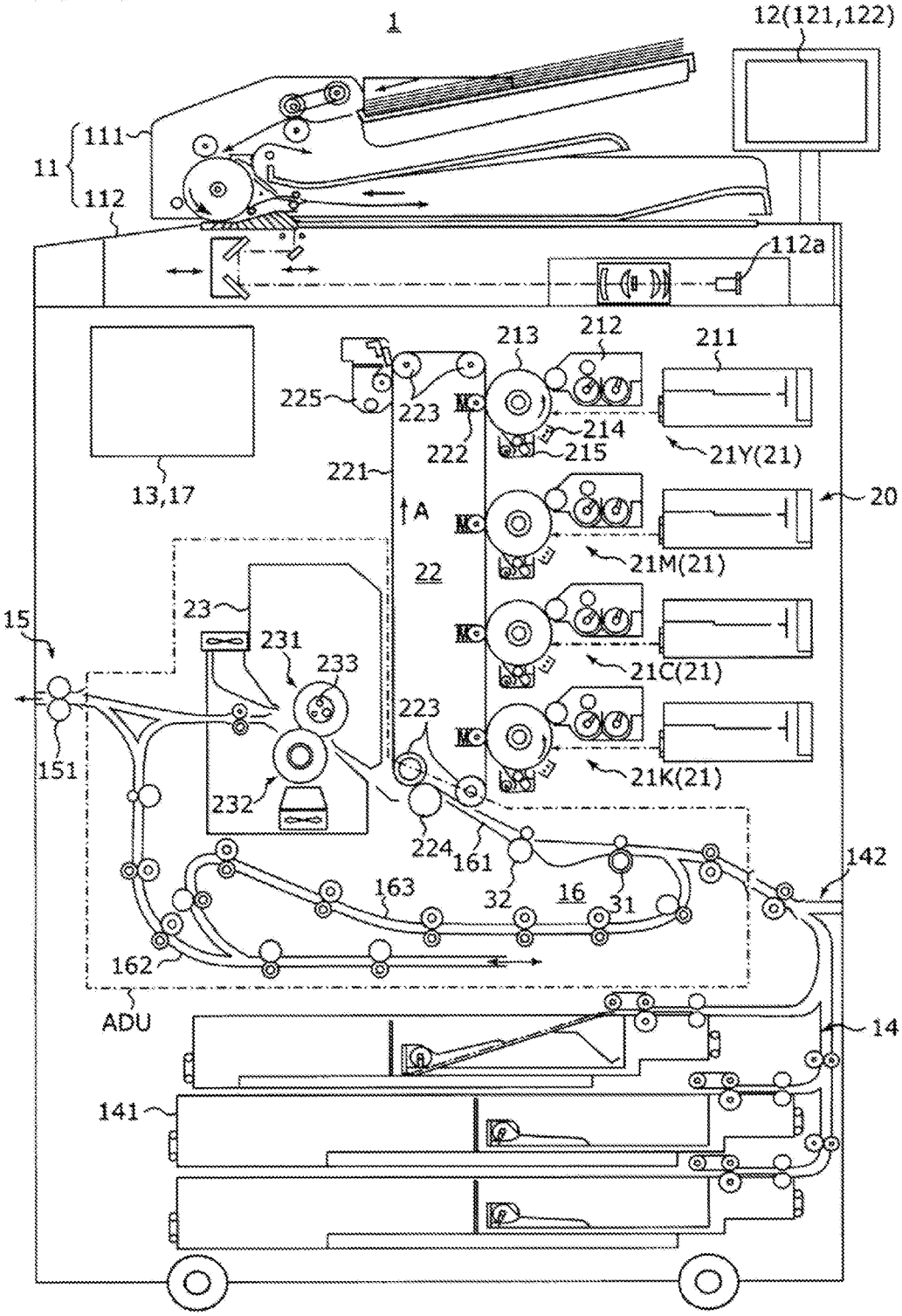
FIG. 3 is a diagram illustrating an overall configuration of an image forming apparatus.
Figure 4:
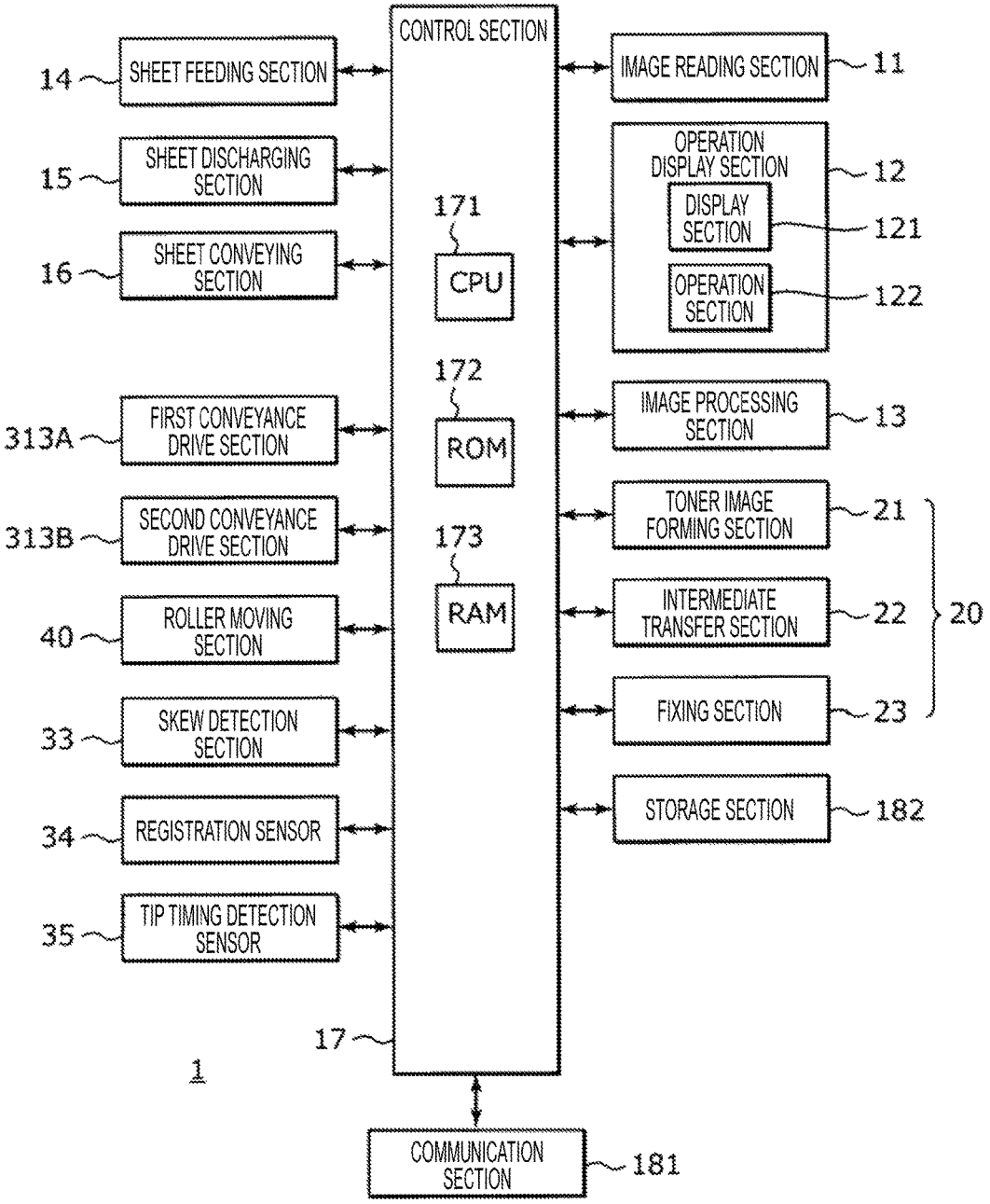
FIG. 4 is a diagram illustrating principal sections of a control system of the image forming apparatus.

FIG. 3 is a diagram illustrating an overall configuration of an image forming apparatus 1. FIG. 4 is a diagram illustrating principal sections of a control system of the image forming apparatus 1.

The image forming apparatus 1 illustrated in FIGS. 3 and 4 is a color image forming apparatus of an intermediate transfer system, using an electrophotographic process technology. For the image forming apparatus 1, a vertical tandem system is employed, in which photosensitive drums 213 corresponding to four colors of CMYK are arranged in series in a traveling direction (vertical direction) of an intermediate transfer belt 221, and respective color toner images are sequentially transferred to the intermediate transfer belt 221 in one time procedure.

That is, the image forming apparatus 1 primarily transfers the respective color toner images of yellow (Y), magenta (M), cyan (C), and black (K) formed on the photosensitive drums 213 to the intermediate transfer belt 221, superimposing the four toner images on the intermediate transfer belt 221, and then secondarily transfers the four colors on a sheet, thereby to form an image.

As illustrated in FIGS. 3 and 4, the image forming apparatus 1 includes an image reading section 11, an operation display section 12, an image processing section 13, an image forming section 20, a sheet feeding section 14, a sheet discharging section 15, a sheet conveying section 16, and a control section 17.

The control section 17 includes a central processing unit (CPU) 171, a read only memory (ROM) 172, a random access memory (RAM) 173, and the like. The CPU 171 reads a program according to processing content from the ROM 172 or a storage section 182, expands the program on the RAM 173, and centrally controls operations of blocks of the image forming apparatus 1 in cooperation with the expanded program.

A communication section 181 includes various interfaces such as a network interface card (NIC), a modulator-demodulator (MODEM), and a universal serial bus (USB).

The storage section 182 is configured from a non-volatile semiconductor memory (so-called flash memory) and a hard disk drive, for example. A lookup table, which is referred when the operations of blocks are controlled, is stored in the storage section 182, for example.

The control section 17 transmits/receives various data to/from an external device (for example, a personal computer) connected to a communication network such as a local area network (LAN) or a wide area network (WAN) through the communication section 181. The control section 17 receives image data (input image data) in page description language (PDL) transmitted from the external device, and forms an image on the sheet based on the image data, for example.

The image reading section 11 includes an automatic document feeding device 111 called auto document feeder (ADF), a document image scanning device 112 (scanner), and the like.

The automatic document feeding device 111 conveys and sends a document placed on a document tray with a conveying mechanism to the document image scanning device 112. The automatic document feeding device 111 can sequentially read images of a large number of documents (including both pages) placed on the document tray.

The document image scanning device 112 optically scans the document conveyed from the automatic document feeding device 111 to a contact glass, or the document placed on the contact glass, forms an image of reflection light from the document, on a light-receiving surface of a charge coupled device (CCD) sensor 112*a*, and reads a document image. The image reading section 11 generates input image data based on a read result by the document image scanning device 112. Predetermined image processing is applied to the input image data in the image processing section 13.

The operation display section 12 is configured from a liquid crystal display (LCD) with a touch panel, for example, and functions as a display section 121 and an operation section 122. The display section 121 displays various operation screens, a state of an image, a status of operations of functions, and the like according to the display control signal which is input by the control section 17. The operation section 122 includes various operation keys such as numeric keypads and a start key, and outputs operation signals to the control section 17 upon receipt of various input operations by a user.

The user can perform setting related to image formation such as document setting, image quality setting, magnification setting, application setting, output setting, one-side/two-side setting, and sheet setting, by operating the operation display section 12.

The image processing section 13 includes a circuit that performs digital image processing according to initial setting or the user setting, for the input image data. For example, the image processing section 13 performs gradation correction based on gradation correction data under control of the control section 17. Further, the image processing section 13 applies various types of correction processing such as color correction and shading correction to the input image data. The image forming section 20 is controlled based on the image data subjected to the various types of processing.

The image forming section 20 includes a toner image forming section 21, an intermediate transfer section 22, a fixing section 23, and the like. The toner image forming section 21 forms toner images with color toners of a Y component, an M component, a C component, and a K component based on the input image data. The intermediate transfer section 22 transfers the toner images formed by the toner image forming section 21 to the sheet. The fixing section 23 fixes the toner images transferred on the sheet.

The toner image forming section 21 is configured from four toner image forming sections 21Y, 21M, 21C, and 21K for Y component, M component, C component, and K component. The toner image forming sections 21Y, 21M, 21C, and 21K have similar configurations, and thus common configuration elements are denoted with the same reference sign for convenience of illustration and description. When these elements are distinguished, the reference sign is presented with Y, M, C, or K. In FIG. 3, the reference signs are given only to the configuration elements of the toner image forming section 21Y for Y component, and the reference signs of the configuration elements of other toner image forming sections 21M, 21C, and 21K are omitted.

The toner image forming section 21 includes an exposing device 211, a developing device 212, a photosensitive drum 213, a charging device 214, a drum cleaning device 215, and the like.

The photosensitive drum 213 is a negative charge type organic photosensitive member (organic photo-conductor, OPC) in which an under coat layer (UCL), a charge generation layer (CGL), and a charge transport layer (CTL) are sequentially layered on a peripheral surface of a conductive cylinder made of aluminum (aluminum stock tube).

The charge generation layer is made of an organic semiconductor obtained such that a charge generating material (for example, a phthalocyanine pigment) is dispersed in a resin binder (for example, polycarbonate), and generates a pair of a positive charge and a negative charge by receiving exposure from the exposing device 211. The charge transport layer is made of one obtained such that a hole transporting material (electron donating nitrogen-containing compound) is dispersed in a resin binder (for example, a polycarbonate resin), and transports the positive charge generated in the charge generation layer to a surface of the charge transport layer.

The charging device 214 is configured from a corona discharger such as a scorotron charging device or a corotron charging device. The charging device 214 negatively charges a surface of the photosensitive drum 213 by corona discharge in a uniform manner.

The exposing device 211 is configured from a light emitting diode (LED) array, an LPH drive section (driver IC), and an LED print head. The LED array has a plurality of linearly arrayed LEDs. The LPH drive section (driver IC) drives individual LEDs. The LED print head includes a lens array that forms an image of emission light from the LED array, on the photosensitive drum 213, and the like. One LED of the LED array corresponds to one dot of an image. The control section 17 controls the LPH drive section, so that a predetermined drive current flows in the LED array, and a specific LED emits light.

The exposing device 211 irradiates the photosensitive drum 213 with light corresponding to an image of each color component. The positive charge generated in the charge generation layer of the photosensitive drum 213 by receiving irradiation of light is transported to the surface of the charge transport layer, so that a surface charge (negative charge) of the photosensitive drum 213 is neutralized. Accordingly, an electrostatic latent image of each color component is formed on the surface of the photosensitive drum 213 by a potential difference from the surroundings.

The developing device 212 accommodates a developer (a two-component developer made of a toner and a magnetic carrier) of each color component. The developing device 212 causes the toner of each color component to adhere to the surface of the photosensitive drum 213, thereby to visualize the electrostatic latent image to form a toner image. To be specific, a development bias voltage is applied to a developer carrier (developing roller), and an electric field is formed between the photosensitive drum 213 and the developer carrier. The charged toner on the developer carrier is moved to, and adheres to an exposed portion of the surface of the photosensitive drum 213, by a potential difference between the photosensitive drum 213 and the developer carrier.

The drum cleaning device 215 includes a drum cleaning blade that slides on the surface of the photosensitive drum 213, and the like, and removes a residual transfer toner remaining on the surface of the photosensitive drum 213 after the primary transfer.

The intermediate transfer section 22 includes the intermediate transfer belt 221, a primary transfer roller 222, a plurality of support rollers 223, a secondary transfer roller 224, a belt cleaning device 225, and the like.

The intermediate transfer belt 221 is configured from an endless belt, and is stretched over the plurality of support rollers 223 in a loop manner. At least one of the plurality of support rollers 223 is configured from a drive roller, and the others are configured from a driven roller. When the drive roller rotates, the intermediate transfer belt 221 travels at a fixed speed in the arrow A direction.

The primary transfer roller 222 is arranged at an inner peripheral surface side of the intermediate transfer belt 221, facing the photosensitive drum 213 of each color component. The primary transfer roller 222 is pressed against the photosensitive drum 213 across the intermediate transfer belt 221, so that a primary transfer nip (hereinafter, referred to as "primary transfer section") for transferring the toner image from the photosensitive drum 213 to the intermediate transfer belt 221 is formed.

The secondary transfer roller 224 is arranged at an outer peripheral surface side of the intermediate transfer belt 221, facing one of the plurality of support rollers 223. The support roller 223 arranged facing the intermediate transfer belt 221 is called backup roller. The secondary transfer roller 224 is pressed against the backup roller across the intermediate transfer belt 221, so that a secondary transfer nip (hereinafter, referred to as "secondary transfer section") for transferring the toner image from the intermediate transfer belt 221 to the sheet is formed.

In the primary transfer section, the toner images on the photosensitive drums 213 are primarily transferred to the intermediate transfer belt 221, superimposing one on another. To be specific, a primary transfer bias is applied to the primary transfer roller 222, and a charge with reverse polarity, which is reverse to the polarity of the toner, is provided to a back surface side (a side coming in contact with the primary transfer roller 222) of the intermediate transfer belt 221, so that the toner image is electrostatically transferred to the intermediate transfer belt 221.

Following that, when the sheet passes through the secondary transfer section, the toner image on the intermediate transfer belt 221 is secondarily transferred to the sheet. To be specific, a secondary transfer bias is applied to the secondary transfer roller 224, and a charge with reverse polarity, which is reverse to the polarity of the toner, is provided to a back surface side (a side coming in contact with the secondary transfer roller 224) of the sheet, so that the toner image is electrostatically transferred to the sheet. The sheet to which the toner image is transferred is conveyed toward the fixing section 23.

The belt cleaning device 225 includes a belt cleaning blade that slides on a surface of the intermediate transfer belt 221, and the like, and removes the residual transfer toner remaining on the surface of the intermediate transfer belt 221 after the secondary transfer.

In the intermediate transfer section 22, a configuration in which the secondary transfer belt is stretched over a plurality of support rollers including the secondary transfer roller in a loop manner (so-called belt type secondary transfer unit) may be employed, in place of the secondary transfer roller 224.

The fixing section 23 includes an upper-side fixing section 231, a lower-side fixing section 232, a heat source 233, a pressing/separating section (not illustrated), and the like. The upper-side fixing section 231 includes a fixing surface-side member arranged at a fixing surface (surface where the toner image is formed) side of the sheet. The lower-side fixing section 232 includes a back surface-side support member arranged at a back surface (surface opposite to the fixing surface) side of the sheet. The heat source 233 heats the fixing surface-side member. The pressing/separating section presses the back surface-side support member against the fixing surface-side member.

For example, in a case where the upper-side fixing section 231 is configured from a roller heating system, a fixing roller serves as the fixing surface-side member, and in a case where the upper-side fixing section 231 is configured from a belt heating system, a fixing belt serves as the fixing surface-side member. Further, for example, in a case where the lower-side fixing section 232 is configured from a roller pressurization system, a pressurization roller serves as the back surface-side support member, and in a case where the lower-side fixing section 232 is configured from a belt pressurization system, a pressurization belt serves as the back surface-side support member. FIG. 3 illustrates a case where the upper-side fixing section 231 is configured from the roller heating system, and the lower-side fixing section 232 is configured from the roller pressurization system.

The upper-side fixing section 231 includes an upper-side fixing section drive section (not illustrated) for rotating the fixing surface-side member. An operation of the upper-side fixing section drive section is controlled by the control section 17, so that the fixing surface-side member is rotated (travels) at a predetermined speed. The lower-side fixing section 232 includes a lower-side fixing section drive section (not illustrated) for rotating the back surface-side support member (not illustrated). An operation of the lower-side fixing section drive section is controlled by the control section 17, so that the back surface-side support member is rotated (travels) at a predetermined speed. When the fixing surface-side member follows the rotation of the back surface-side support member, the upper-side fixing section drive section is not necessary.

The heat source 233 is arranged inside or near the fixing surface-side member. An output of the heat source 233 is controlled by the control section 17, so that the fixing surface-side member is heated and held at a predetermined temperature (for example, a fixing permissible temperature, or fixing idling temperature). The control section 17 controls the output of the heat source 233 based on a detection result of a fixing temperature detection section (not illustrated) arranged adjacent to the fixing surface-side member.

The pressing/separating section (not illustrated) presses the back surface-side support member against the fixing surface-side member. The pressing/separating section comes in contact with both end portions of an axis that supports the back surface-side support member, and independently presses the both ends of the axis. Accordingly, balance of nip pressure in an axial direction in a fixing nip can be adjusted. An operation of the pressing/separating section (not illustrated) is controlled by the control section 17, and the back surface-side support member is pressed against the fixing surface-side member, so that the fixing nip that pinches and conveys the sheet is formed.

The sheet to which the toner image is secondarily transferred, and conveyed along a sheet passing path is heated and pressurized when passing through the fixing section 23. Accordingly, the toner image is fixed on the sheet.

Note that the fixing section 23 may include a blowing section that blows air toward the fixing surface-side member or the back surface-side support member in order to cool the fixing surface-side member or the back surface-side support member, or to separate the sheet from the fixing surface-side member or the back surface-side support member.

The sheet feeding section 14 includes a sheet feeding tray section 141 and a manual feeding section 142. In the sheet feeding tray section 141, sheets (standard paper and special paper) identified based on a basis weight, a size, or the like are accommodated, for each paper type set in advance. The sheet feeding section 14 sends the sheet fed from the sheet feeding tray section 141 or the manual feeding section 142 to the sheet conveying section 16.

The sheet discharging section 15 includes a sheet discharging roller section 151, and the like, and discharges the sheet sent from the sheet conveying section 16 to an outside of the apparatus.

The sheet conveying section 16 includes a main conveying section 161, a switchback conveying section 162, a back surface printing conveying section 163, a sheet passing path switch section (not illustrated), and the like. A part of the sheet conveying section 16 is incorporated into one unit together with the fixing section 23, for example, and is detachably mounted in the image forming apparatus 1 (sheet conveying unit ADU).

The main conveying section 161 includes, as sheet conveying elements that pinch and convey the sheet, a plurality of conveying roller sections including a loop roller section 31 and a registration roller section 32. The main conveying section 161 conveys and passes the sheet fed from the sheet feeding tray section 141 or the manual feeding section 142 to the image forming section 20 (the secondary transfer section and the fixing section 23), and conveys the sheet sent from the image forming section 20 (the fixing section 23) toward the sheet discharging section 15.

The switchback conveying section 162 stops the sheet sent form the fixing section 23 once, reverses the conveying direction, and conveys the sheet to the sheet discharging section 15 or the back surface printing conveying section 163.

The back surface printing conveying section 163 is a circulation path that conveys the sheet switched back in the switchback conveying section 162 to the main conveying section 161. The sheet is passed to the main conveying section 161 in a state where a second surface (back surface) faces upward.

The sheet passing path switch section (not illustrated) switches the sheet passing path, according on whether the sheet sent from the fixing section 23 is discharged as it is, or reversed and discharged, or conveyed to the back surface printing conveying section 163. To be specific, the control section 17 controls an operation of the sheet passing path switch section based on processing content (one-sided/two-sided printing, face up/face down sheet discharging, or the like) of the image forming processing.

The sheet fed from the sheet feeding section 14 is conveyed by the main conveying section 161 to the image forming section 20. Then, when the sheet passes through the secondary transfer section, the toner image on the intermediate transfer belt 221 is collectively secondarily transferred to a first surface (fixing surface) of the sheet, and fixing processing is applied to the sheet in the fixing section 23.

The sheet on which the image is formed is discharged by the sheet discharging section 15 to an outside of the apparatus. When images are formed on both surfaces of the sheet, the sheet with the image formed on the first surface is sent to the switchback conveying section 162, and is reversed by passing through the back surface printing conveying section 163 and returning to the main conveying section 161, so that the image is formed on a second surface.

Figure 5:
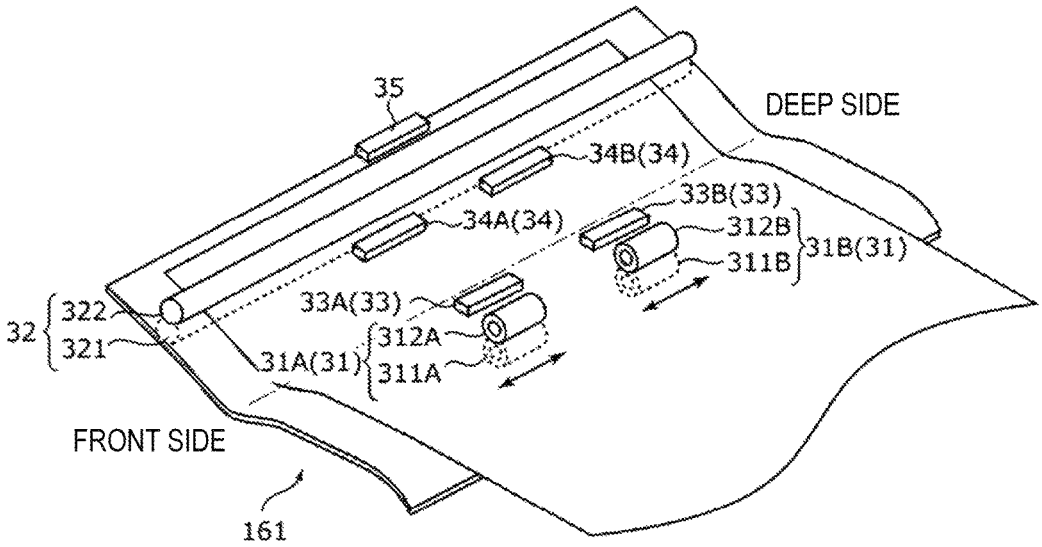
FIG. 5 is a diagram illustrating a part of a sheet conveying section including a loop roller section (skew correction roller sections)

FIG. 5 is a diagram illustrating a configuration of the sheet passing path between the loop roller section 31 and the registration roller section 32 in the main conveying section 161. As illustrated in FIG. 5, the main conveying section 161 includes the loop roller section 31, the registration roller section 32, a skew detection section 33, a registration sensor 34, and a tip timing detection sensor 35.

The loop roller section 31 includes a first loop roller section 31A arranged at a front side in the sheet width direction, and a second loop roller section 31B arranged at a deep side in the sheet width direction.

The first loop roller section 31A includes a drive roller 311A and a driven roller 312A. Similarly, the second loop roller section 31B includes a drive roller 311B and a driven roller 312B.

The control section 17 controls a first conveyance drive section 313A (see FIG. 4), so that a conveying operation (conveying speed) of the drive roller 311A is controlled. Further, the control section 17 controls the second conveyance drive section 313B (see FIG. 4), so that a conveying operation (conveying speed) of the drive roller 311B is controlled. That is, the conveying speeds of the first loop roller section 31A and the second loop roller section 31B can be independently controlled.

The registration roller section 32 includes a drive roller 321 and a driven roller 322 extending in the sheet width direction. The sheet sent from the loop roller section 31 butts against a nip (registration nip) of the registration roller section 32, and is sent to the image forming section 20 at predetermined timing. That is, the conveying operation (conveyance start timing and the conveying speed) of the registration roller section 32 is controlled such that timing when the sheet reaches the secondary transfer section, and timing when the toner image formed on the intermediate transfer belt 221 reaches the secondary transfer section accord with each other.

The skew detection section 33 includes a first skew detection sensor 33A arranged at the front side in the sheet width direction, and a second skew detection sensor 33B arranged at the deep side in the sheet width direction, at a downstream side of the loop roller section 31 in the sheet conveying direction. Each of the first skew detection sensor 33A and the second skew detection sensor 33B detects a tilt of the sheet immediately after passing through the loop roller section 31 based on the timing when the sheet is detected.

The registration sensor 34 includes a first registration sensor 34A arranged at the front side in the sheet width direction, and a second registration sensor 34B arranged at the deep side in the sheet width direction, at an upper stream side of the registration roller section 32 in the sheet conveying direction. Each of the first registration sensor 34A and the second registration sensor 34B detects a tilt of the sheet immediately before entering the registration roller section 32 based on timing when the sheet is detected.

The tip timing detection sensor 35 is arranged at a downstream side of the registration roller section 32 in the sheet conveying direction. Whether the sheet is normally conveyed by the registration roller section 32 is determined based on a detection result of the tip timing detection sensor 35.

The first skew detection sensor 33A, the second skew detection sensor 33B, the registration sensor 34, and the tip timing detection sensor 35 are configured from, for example, a reflection type or transmission type optical sensor.

In the present embodiment, the loop roller section 31 includes a roller moving section 40 (see FIG. 4) that independently moves the first loop roller section 31A and the second loop roller section 31B in the sheet width direction. The roller moving section 40 moves the first loop roller section 31A or the second loop roller section 31B in the sheet width direction, thereby to remove a loop distortion extending in the sheet conveying direction, which is generated in association with skew correction.

The roller moving section 40 is configured from a first roller moving section 40A and a second roller moving section 40B. The first roller moving section 40A moves the first loop roller section 31A in the sheet width direction. The second roller moving section 40B moves the second loop roller section 31B in the sheet width direction. The control section 17 controls the roller moving section 40, so that moving operations of the first loop roller section 31A and the second loop roller section 31B are controlled.

Figure 6:
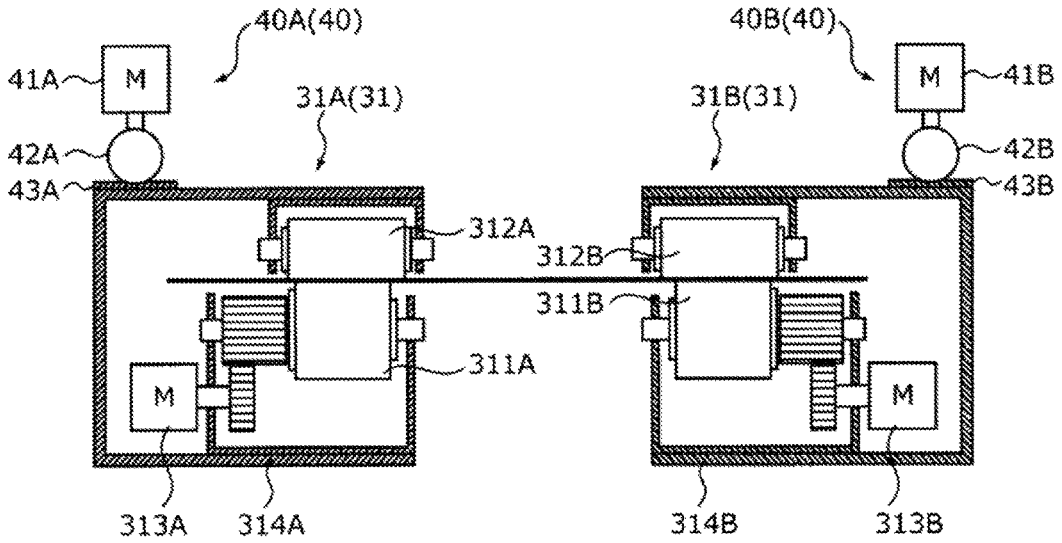
FIG. 6 is a diagram illustrating an example of the roller moving section.

FIG. 6 is a diagram illustrating an example of the roller moving section 40. Here, as the roller moving section 40, a rack and pinion mechanism is used. Since configurations of the first roller moving section 40A and the second roller moving section 40B are the same, the first roller moving section 40A will be described.

As illustrated in FIG. 6, the drive roller 311A, the driven roller 312A, and the first conveyance drive section 313A (drive motor) that configure the first loop roller section 31A are fixed in a frame 314A. A moving drive motor 41A is connected to the frame 314A through a power transmission section made of a rack 43A and a pinion 42A.

The moving drive motor 41A is forwardly rotated when moving the first loop roller section 31A outward in the sheet width direction, and is reversely rotated when moving the first loop roller section 31A inward in the sheet width direction, and putting the first loop roller section 31A back to an original state (home position). Power of a moving drive motor 315A is transmitted to the frame 314A through the rack 43A and the pinion 42A, so that the drive roller 311A and the driven roller 312A are integrally moved in the sheet width direction. Accordingly, the sheet is stretched out in the sheet width direction. Therefore, the loop distortion generated in association with the skew direction is removed.

As illustrated in FIG. 6, when the rack and pinion mechanism is used as the roller moving section 40, a moving amount of the first loop roller section 31A can be controlled by control of a rotation amount of the moving drive motor 41A.

Figure 7:
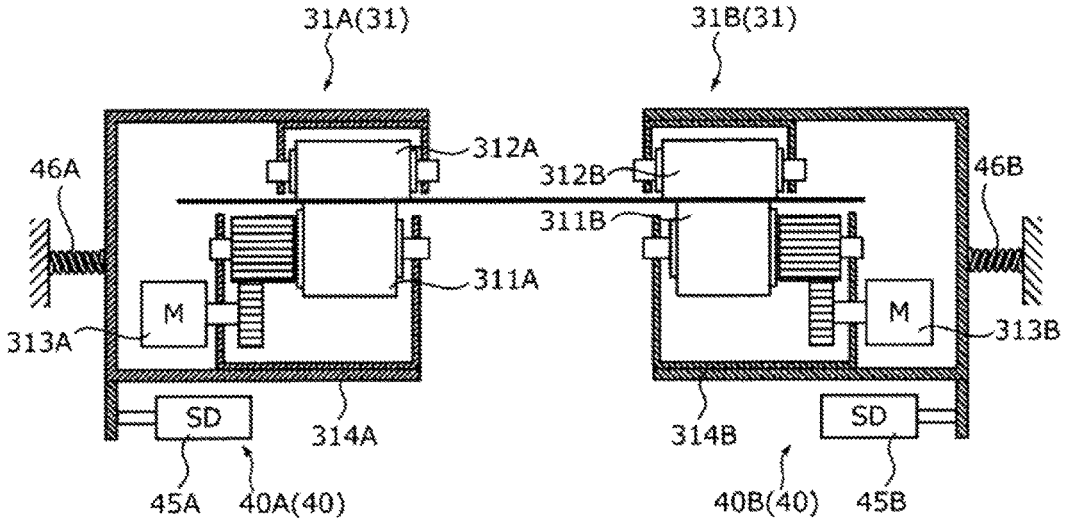
FIG. 7 is a diagram illustrating another example of the roller moving section.

FIG. 7 is a diagram illustrating another example of the roller moving section 40. Here, a solenoid is used as the roller moving section 40. Since the configurations of the first roller moving section 40A and the second roller moving section 40B are the same, the first roller moving section 40A will be described.

As illustrated in FIG. 7, the drive roller 311A, the driven roller 312A, and the first conveyance drive section 313A (drive motor) that configure the first loop roller section 31A are fixed in the frame 314A. A plunger of a solenoid 45A is connected to the frame 314A. Further, an elastic member 46A stretching in the sheet width direction is connected to the frame 314A.

For example, in a case where the elastic member 46A is configured from a compression spring, the first loop roller section 31A is positioned at an innermost side in the sheet width direction, in an unloaded state. This state is the home position. When the first loop roller section 31A is moved outward in the sheet width direction, the solenoid 45A is caused to be in an ON state (an energized state), the plunger is pushed out, and the elastic member 46A becomes in a compressed state. When the first loop roller section 31A is moved inward in the sheet width direction, and is put back to the home position, the solenoid 45A is caused to be in an OFF state (a non-energized state), and the first loop roller section 31A is returned to the home position by restring force of the elastic member 46A.

Further, for example, in a case where the elastic member 46A is configured from a tension spring, the first loop roller section 31A is positioned at an outermost side in the sheet width direction, in an unloaded state. Normally, the solenoid 45A is in the ON state, the plunger is pulled in, and the elastic member 46A is in a pulled state. That is, when the solenoid 45A is in the ON state, the first loop roller section 31A is urged outward in the sheet width direction. This state is the home position. When the first loop roller section 31A is moved outward in the sheet width direction, the solenoid 45A is turned to the OFF state, and the first loop roller section 31A is moved outward in the sheet width direction by the restoring force of the elastic member 46A. The sheet is conveyed in a state of being provided adequate tension in the width direction. Accordingly, an effect to remove the loop distortion is further stabilized.

In the example illustrated in FIG. 7, the drive roller 311A and the driven roller 312A are integrally moved in the sheet width direction, by cooperation of the solenoid 45A and the elastic member 46A. Accordingly, the sheet is stretched outward in the sheet width direction, and thus the loop distortion generated in association with the skew correction is removed.

If a flowing current of the solenoid 45A can be controlled, the moving amount of the first loop roller section 31A can be controlled.

In the image forming apparatus 1, the control section 17 controls the conveying operation (conveying speed) of the first loop roller section 31A and the conveying operation (conveying speed) of the second loop roller section 31B based on a detection result of the skew detection section 33. The control section 17 makes the conveying speed of one of the first loop roller section 31A and the second loop roller section 31B, the one to which the sheet enters first, slower than the conveying speed of the other, so that the sheet is rotationally moved, the skew is corrected. That is, the loop roller section 31 (the first loop roller section 31A and the second loop roller section 31B) functions as skew correction roller sections.

Figure 1:
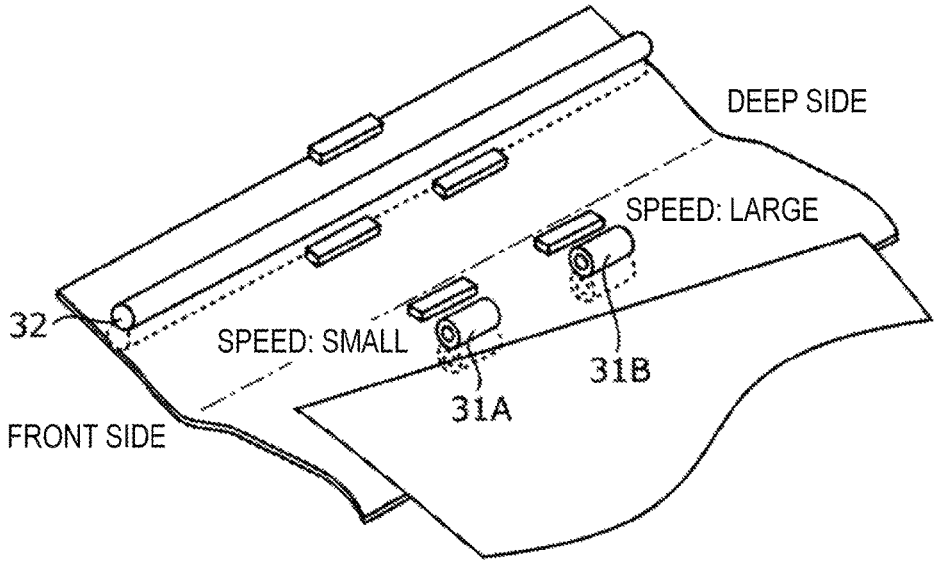
FIG. 1 is a diagram illustrating a conveyance state of a sheet in skew correction roller sections.
Figure 2:
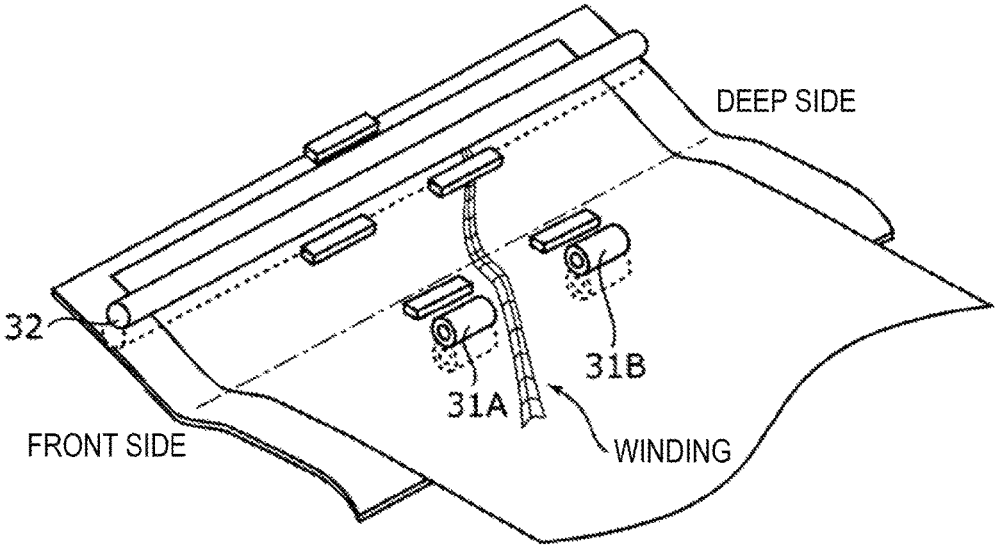
FIG. 2 is a diagram illustrating a distortion (loop distortion) of a sheet caused when skew correction is performed.

Here, the loop distortion is caused in association with a skew correction operation, depending on a paper type of the sheet used in the image formation (see FIG. 2). In the present embodiment, either the first loop roller section 31A or the second loop roller section 31B is moved outward in the sheet width direction, so that the loop distortion caused in the sheet is removed. To be specific, the control section 17 executes skew correction processing according to the flowchart illustrated in FIG. 8.

Figure 8:
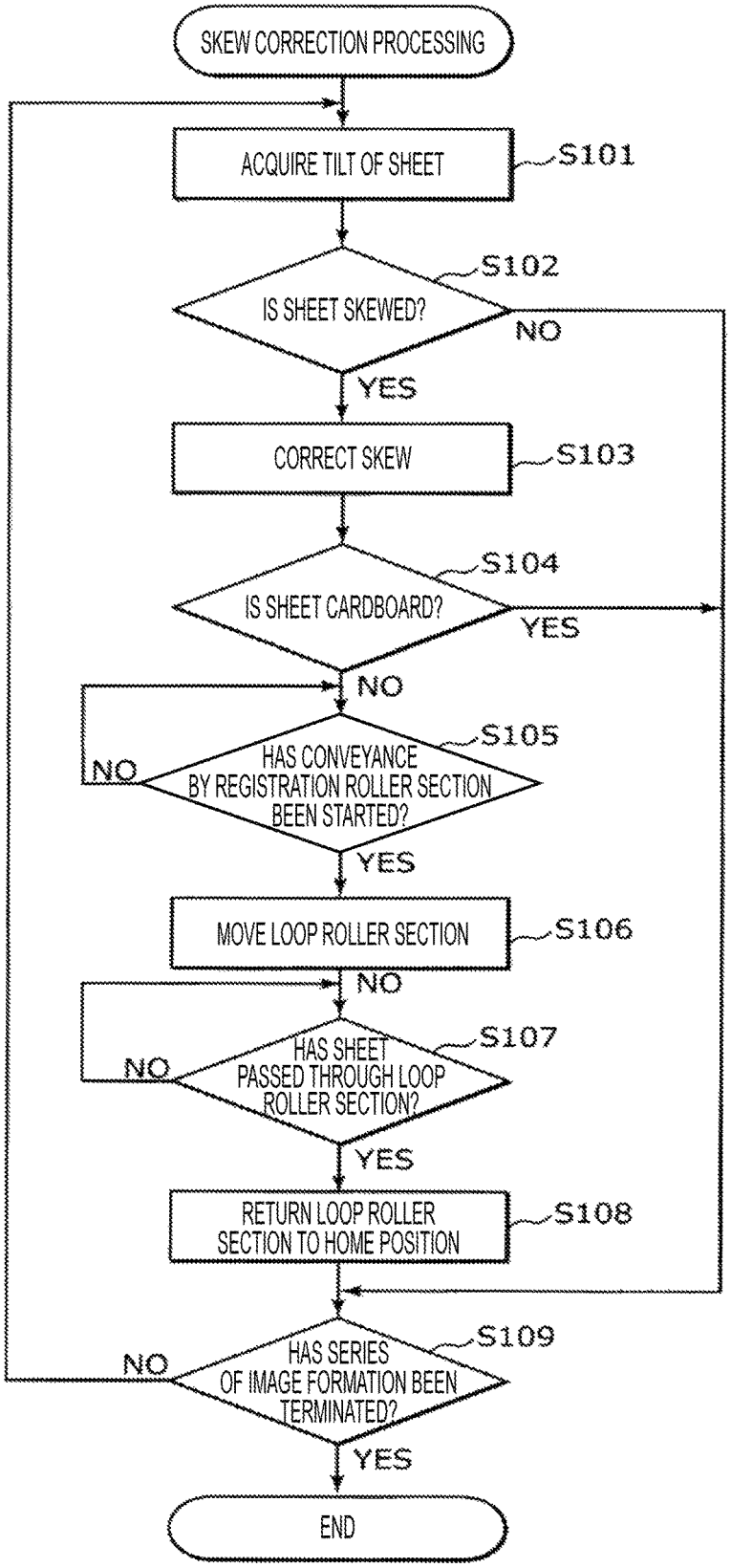
FIG. 8 is a flowchart illustrating an example of skew correction processing.

FIG. 8 is a flowchart illustrating an example of skew correction processing. This processing is realized by the CPU 171 executing a predetermined program stored in the ROM 172, in association with start of the image forming processing for a sheet in the image forming apparatus 1.

At step S101, the control section 17 acquires a detection result of the skew detection section 33.

At step S102, the control section 17 determines whether the sheet is skewed based on the detection result of the skew detection section 33. When detection timing of the sheet by the first skew detection sensor 33A and detection timing of the sheet by the second skew detection sensor 33B are different, the sheet is skewed. When the sheet is skewed ("YES" at step S102), the processing is move onto step S103. When the sheet is not skewed ("NO" at step S102), the processing is moved onto step S109.

At step S103, the control section 17 controls the conveying operations of the first loop roller section 31A and the second loop roller section 31B to correct the skew of the sheet. To be specific, the control section 17 makes the conveying speed of one of the first loop roller section 31A and the second loop roller section 31B, the one to which the sheet enters first, slower than the conveying speed of the other. Accordingly, the sheet is rotationally moved, and the skew is corrected.

At step S104, the control section 17 determines whether the sheet used in the image formation is a cardboard. When the sheet used in the image formation is a cardboard ("YES" at step S104), the loop distortion is less likely to be generated, and it is not necessary to perform a loop distortion removal operation of moving the first loop roller section 31A or the second loop roller section 31B in the sheet width direction. Therefore, the processing is moved onto step S109. When the sheet used in the image formation is not a cardboard ("NO" at step S105), the processing is moved onto step S105, and the loop distortion removal operation is performed.

The loop distortion is less likely to be generated in the case of a cardboard, and is more likely to be generated in the case of not a cardboard. Therefore, here, necessity of the loop distortion removal operation is simply determined according to whether the sheet used in the image formation is a cardboard. The necessity of the loop distortion removal operation may be determined based on detailed sheet conditions including the paper type, the basis weight, the thickness, the stiffness, the paper size, and the like.

At step S105, the control section 17 determines whether the conveying operation by the registration roller section 32 has been started. When the conveying operation by the registration roller section 32 is started ("YES" at step S105), the processing is moved onto step S106. That is, after the conveying operation by the registration roller section 32 is started, the loop distortion removal operation is performed. In this way, it is favorable to perform the loop distortion removal operation after the tip of the sheet butts against the registration nip, and bending of the sheet is formed between the registration roller section 32 and the loop roller section 31. Accordingly, occurrence of another skew in the sheet can be prevented by the loop distortion removal operation.

At step S106, the control section 17 controls the first roller moving section 40A or the second roller moving section 40B to move either the first loop roller section 31A or the second loop roller section 31B in the sheet width direction. Accordingly, the loop distortion caused in the sheet can be removed, and thus the sheet passes through the registration roller section 32 in a flat state.

At this time, it is favorable to move one of the first loop roller section 31A and the second loop roller section 31B, the one having a higher conveying speed at the time of skew correction, outward in the sheet width direction. That is, an end portion of the sheet at the one having a higher conveying speed at the time of skew correction is tilted inward and the loop distortion is caused. Therefore, the end portion of the sheet is stretched outward in the sheet width direction. Accordingly, a decrease in position accuracy of an image can be prevented by the loop distortion removal operation.

Further, the moving amount (including a case where the moving amount is 0) of the first loop roller section 31A or the second loop roller section 31B in the loop distortion removal operation is favorably determined based on the sheet conditions and the detection result of the skew detection section 33. Accordingly, the movement of the first loop roller section 31A or the second loop roller section 31B can be suppressed to a necessary minimum amount. Therefore, damage to the sheet and occurrence of skew due to excess movement can be prevented.

At step S107, the control section 17 determines whether a rear end of the sheet has passed through the loop roller section 31. When the rear end of the sheet passes through the loop roller section 31 ("YES" at step S107), the processing is moved onto step S108.

At step S108, the control section 17 controls the first roller moving section 40A or the second roller moving section 40B to return the first loop roller section 31A or the second loop roller section 31B to the original state (home position).

The return operation of this time is favorably performed by the time when a next sheet enters after the sheet passed through the loop roller section 31. Accordingly, the conveyance state of the sheet can be prevented from being subject to a bad influence due to the return operation to the home position.

At step S109, the control section 17 determines whether a series of the image forming processing has been terminated. The series of the image forming processing is processing of performing image formation set with a signal (for example, a printing job) instructing the image formation. When the series of the image forming processing has been terminated ("YES" at step S109), the skew correction processing is terminated. When the series of the image forming processing has not been terminated ("NO" at step S109), the processing of step S101 and subsequent steps is repeated.

Figure 9:
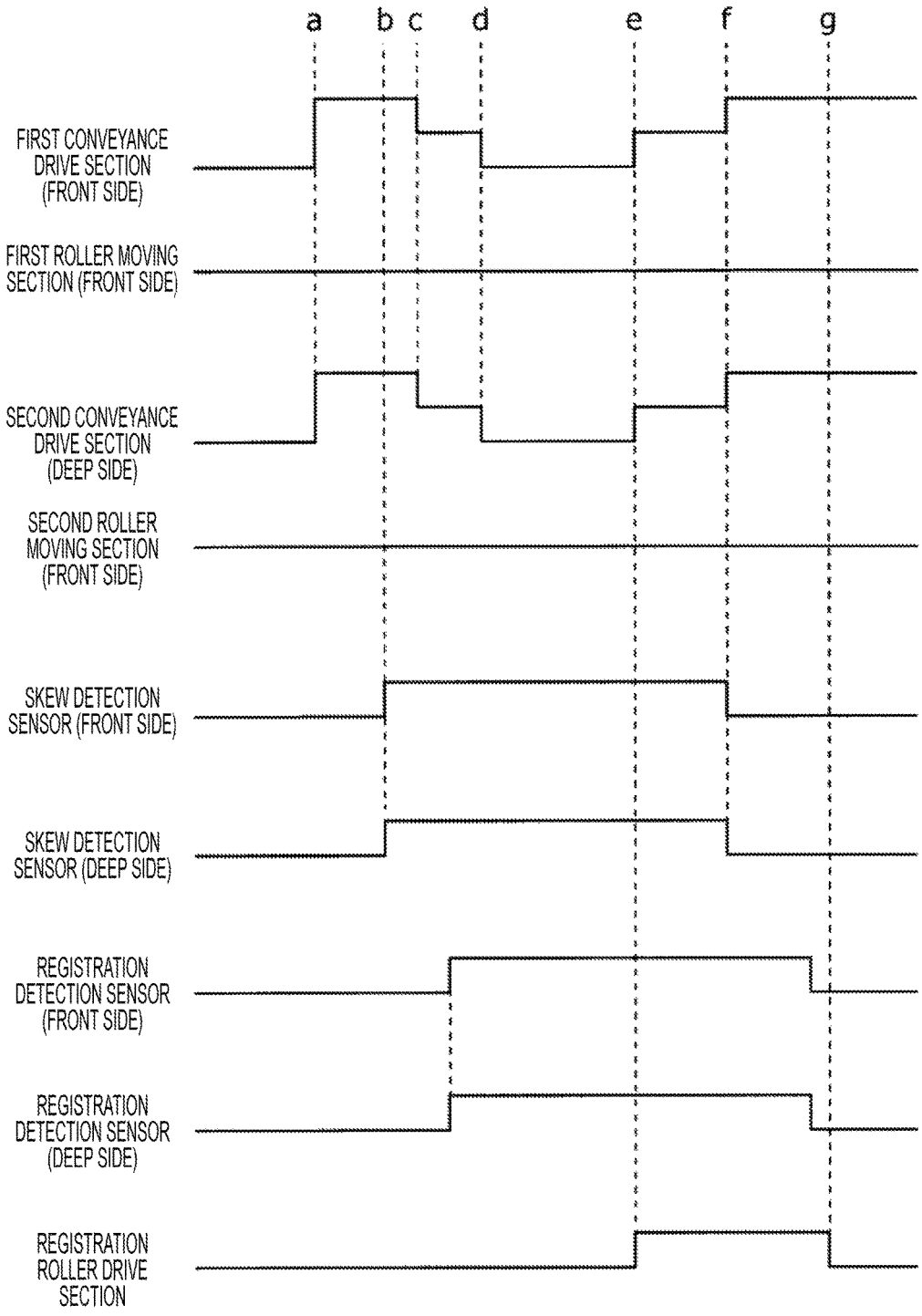
FIG. 9 is a timing chart illustrating an example (without skew) of an operation of the loop roller section.
Figure 10:
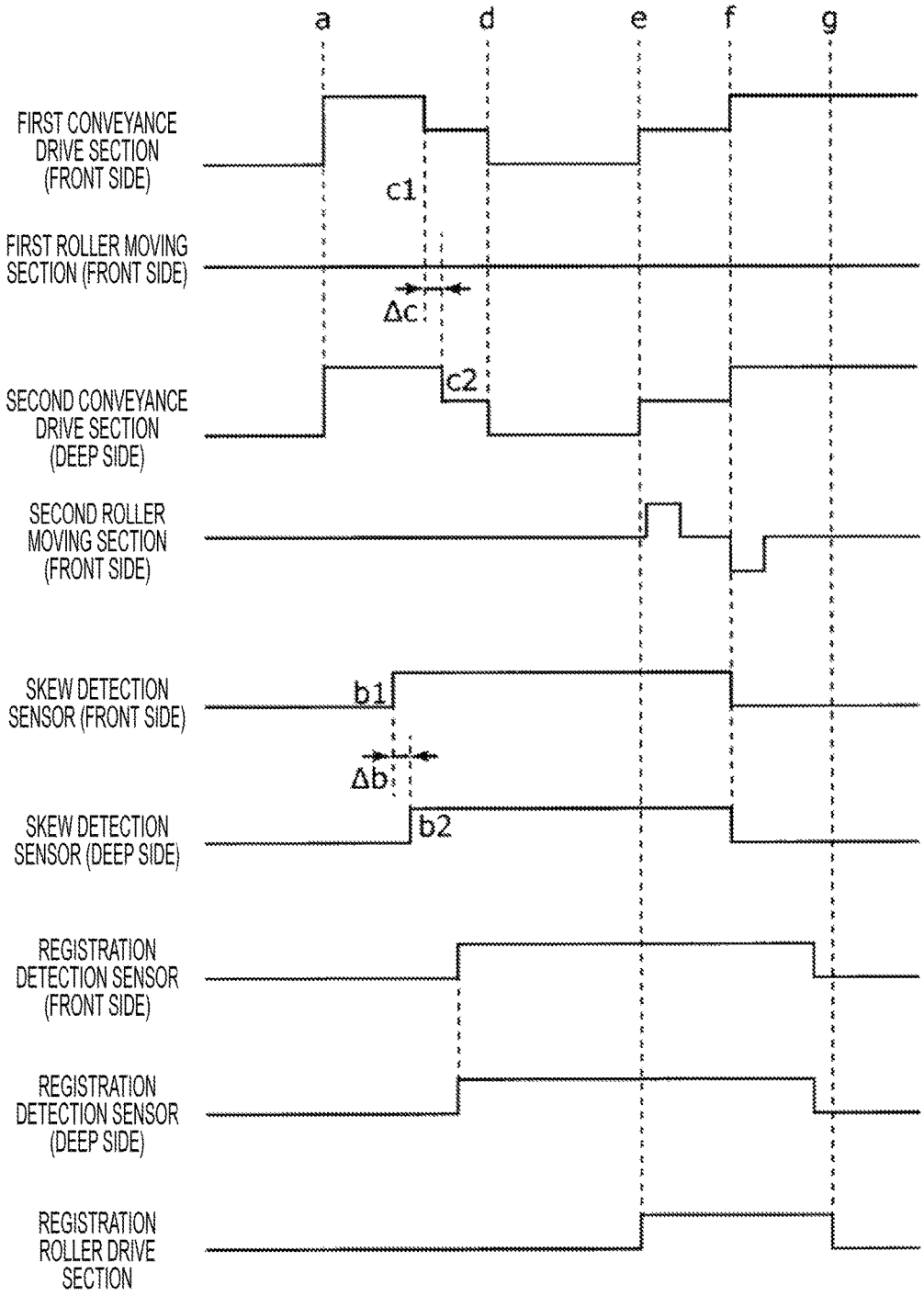
FIG. 10 is a timing chart illustrating another example (with skew) of an operation of the loop roller section.
Figure 11:
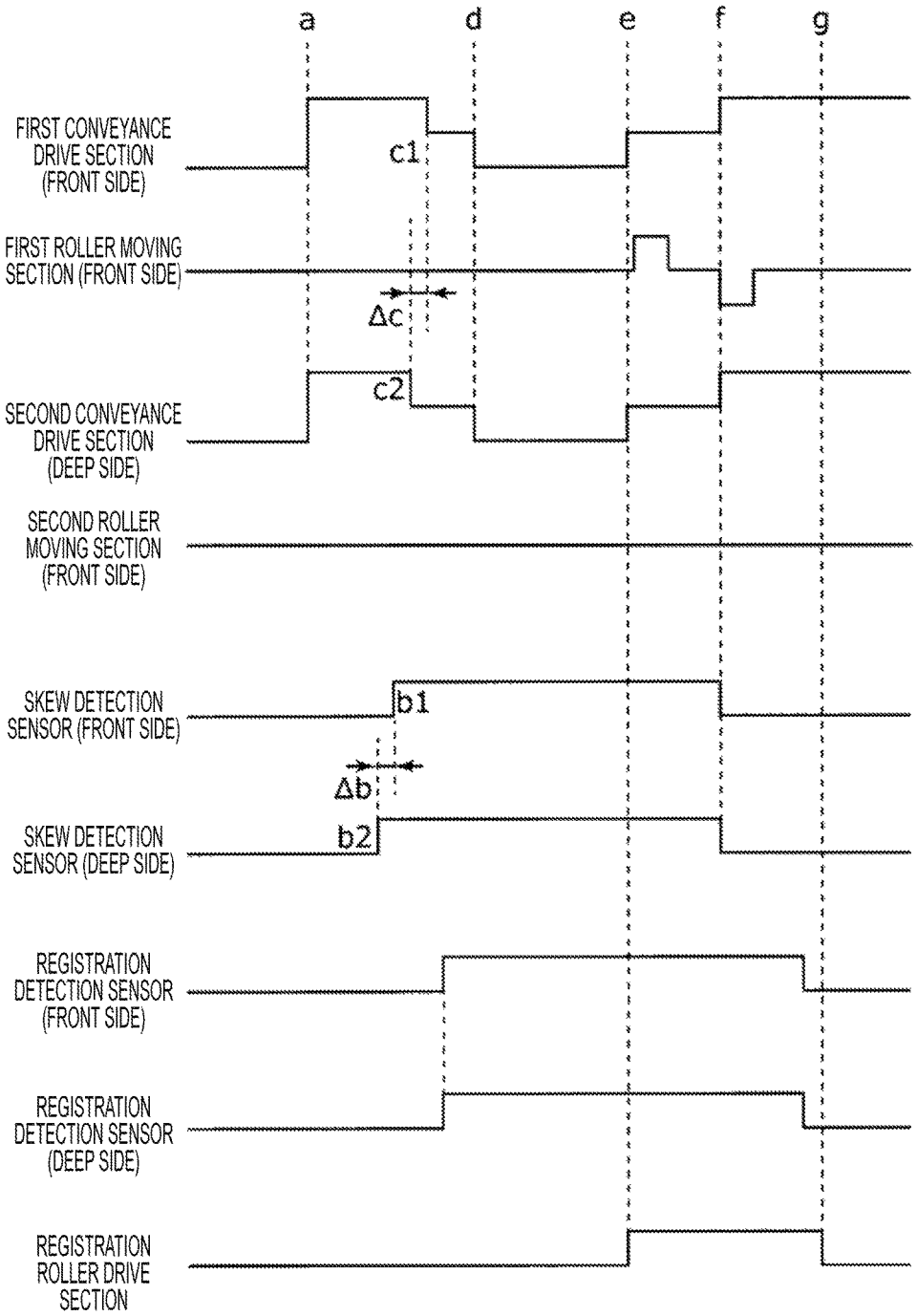
FIG. 11 is a timing chart illustrating another example (with skew) of an operation of the loop roller section.

FIGS. 9 to 11 illustrate operations (the conveying operation and the moving operation) of the loop roller section 31 in the skew correction processing.

FIG. 9 is a timing chart illustrating the operations of the loop roller section 31 of when the sheet is not skewed. As illustrated in FIG. 7, first, the first conveyance drive section 313A and the second conveyance drive section 313B are driven, and the conveying operations by the first loop roller section 31A and the second loop roller section 31B are started (timing a). When the sheet is fed from the upper stream side in the sheet conveying direction, and reaches the loop roller section 31, the sheet is conveyed by the conveying operations of the first loop roller section 31A and the second loop roller section 31B.

When the tip of the sheet that has passed through the loop roller section 31 reaches the skew detection section 33, the sheet is detected by the first skew detection sensor 33A and the second skew detection sensor 33B (timing b). When the sheet is not skewed, the detection timing of the sheet by the first skew detection sensor 33A and by the second skew detection sensor 33B is the same.

When the sheet has passed the loop roller section 31 to a certain extent, the conveying speeds of the first loop roller section 31A and the second loop roller section 31B are decreased (timing c).

When the tip of the sheet reaches the registration sensor 34, the sheet is detected by the registration sensor 34. The sheet is not skewed, and thus the detection timing of the sheet by the front-side registration sensors 34 and by the deep-side registration sensors 34 is the same.

When the tip of the sheet reaches the registration roller section 32, and at timing when bending is formed in the sheet, the conveying operations of the first loop roller section 31A and the second loop roller section 31B are stopped (timing d).

Following that, the conveying operation by the registration roller section 32 is started at predetermined timing (timing e). At the same time, the conveying operations of the first loop roller section 31A and the second loop roller section 31B are resumed.

When the rear end of the sheet passes through the loop roller section 31, the conveying speeds of the first loop roller section 31A and the second loop roller section 31B are increased, and acceptance of the next sheet is prepared (timing f).

Then, when the rear end of the sheet passes through the registration roller section 32, the conveying operation of the registration roller section 32 is stopped (timing g).

FIG. 10 is a timing chart illustrating the operations of the loop roller section 31 of when the sheet is skewed such that the tip of the sheet enters the first loop roller section 31A first. As illustrated in FIG. 10, first, the first conveyance drive section 313A and the second conveyance drive section 313B are driven, and the conveying operations by the first loop roller section 31A and the second loop roller section 31B are started (timing a). When the sheet is fed from the upper stream side in the sheet conveying direction, and reaches the loop roller section 31, the sheet is conveyed by the conveying operations of the first loop roller section 31A and the second loop roller section 31B.

When the tip of the sheet that has passed through the loop roller section 31 reaches the skew detection section 33, the sheet is detected by the first skew detection sensor 33A and the second skew detection sensor 33B. Here, the tip of the sheet is detected by the first skew detection sensor 33A first (timing b1), and is then detected by the second skew detection sensor 33B (timing b2).

When the sheet has passed the loop roller section 31 to a certain extent, the conveying speeds of the first loop roller section 31A and the second loop roller section 31B are decreased. Here, the conveying speed of the first loop roller section 31A is decreased (timing c1), and then the conveying speed of the second loop roller section 31B is decreased (timing c2). That is, the skew correction is performed during an interval $\Delta c$ in which the conveying speed of the second loop roller section 31B becomes faster than the conveying speed of the first loop roller section 31A. $\Delta c$ is set longer as the degree of skew $\Delta b$ is large.

When the tip of the sheet reaches the registration sensor 34, the sheet is detected by the registration sensor 34. Since the skew of the sheet has been corrected, the detection timing of the sheet by the front-side registration sensors 34 and by the deep-side registration sensors 34 is the same.

When the tip of the sheet reaches the registration roller section 32, and bending is formed in the sheet, the conveying operations of the first loop roller section 31A and the second loop roller section 31B are stopped (timing d).

Following that, the conveying operation by the registration roller section 32 is started at predetermined timing (timing e). At the same time, the conveying operations of the first loop roller section 31A and the second loop roller section 31B are resumed. Further, the second loop roller section 31B (one having a higher conveying speed at the time of the skew correction) is moved outward in the sheet width direction by the second roller moving section 40B.

When the rear end of the sheet has passed through the loop roller section 31, the conveying speeds of the first loop roller section 31A and the second loop roller section 31B are increased, and acceptance of a next sheet is prepared (timing f). Further, the second loop roller section 31B is returned to the home position by the time when the next sheet enters.

Then, when the rear end of the sheet has passed through the registration roller section 32, the conveying operation of the registration roller section 32 is stopped (timing g).

FIG. 11 is a timing chart illustrating the operations of the loop roller section 31 of when the sheet is skewed such that the tip of the sheet enters the second loop roller section 31B first. As illustrated in FIG. 11, first, the first conveyance drive section 313A and the second conveyance drive section 313B are driven, and the conveying operations by the first loop roller section 31A and the second loop roller section 31B are started (timing a). When the sheet is fed from the upper stream side in the sheet conveying direction, and reaches the loop roller section 31, the sheet is conveyed by the conveying operations of the first loop roller section 31A and the second loop roller section 31B.

When the tip of the sheet that has passed through the loop roller section 31 reaches the skew detection section 33, the sheet is detected by the first skew detection sensor 33A and the second skew detection sensor 33B. Here, the tip of the sheet is detected by the second skew detection sensor 33B first (timing b2), and is then detected by the first skew detection sensor 33A (timing b1).

When the sheet has passed the loop roller section 31 to a certain extent, the conveying speeds of the first loop roller section 31A and the second loop roller section 31B are decreased. Here, the conveying speed of the second loop roller section 31B is decreased first (timing c2), and then the conveying speed of the first loop roller section 31A is decreased (timing c1). That is, the skew correction is performed during an interval Δc in which the conveying speed of the first loop roller section 31A becomes faster than the conveying speed of the second loop roller section 31B. Δc is set longer as the degree of skew Δb is larger.

When the tip of the sheet reaches the registration sensor 34, the sheet is detected by the registration sensor 34. Since the skew of the sheet has been corrected, the detecting timing of the sheet by the front-side registration sensor 34 and by the deep-side registration sensor 34 is the same.

When the tip of the sheet reaches the registration roller section 32, and bending is formed in the sheet, the conveying operations of the first loop roller section 31A and the second loop roller section 31B are stopped (timing d).

Following that, the conveying operation by the registration roller section 32 is started at predetermined timing (timing e). At the same time, the conveying operations of the first loop roller section 31A and the second loop roller section 31B are resumed. Further, the first loop roller section 31A (one having a faster conveying speed at the time of the skew correction) is moved outward in the sheet width direction, by the first roller moving section 40A.

When the rear end of the sheet has passed through the loop roller section 31, the conveying speeds of the first loop roller section 31A and the second loop roller section 31B are increased, and acceptance of a next sheet is prepared (timing f). Further, the first loop roller section 31A is returned to the home position by the time when the next sheet enters.

Then, when the rear end of the sheet has passed through the registration roller section 32, the conveying operation of the registration roller section 32 is stopped (timing g).

As described above, the sheet conveying device (main conveying section 161) according to the present embodiment includes the skew detection section (33) that detects the tilt of the sheet to be conveyed, the two skew correction roller sections (the first loop roller section 31A and the second loop roller section 31B) that can be independently driven, and are arranged side by side in the sheet width direction, a downstream-side conveying roller section (the registration roller section 32) arranged at the downstream of the skew correction roller sections (31A and 31B) in the sheet conveying direction, and the control section (17) that controls the conveying operations of the skew correction roller sections (31A and 31B) based on the detection result of the skew detection section (33). At least one of the skew correction roller sections (31A and 31B) is configured to be movable in the sheet width direction (roller moving section 40). Then, the control section (17) moves at least one of the skew correction roller sections (31A and 31B) outward in the sheet width direction at predetermined timing.

According to the sheet conveying device (main conveying section 161) of the embodiment, the loop distortion extending in the sheet conveying direction generated in association with the skew correction of the sheet is removed, before the sheet passes through the downstream-side conveying roller section (registration roller section 32). Therefore, the occurrence of wrinkles associated with the skew correction of the sheet can be prevented.

Further, according to the image forming apparatus (1) of the embodiment, a high-quality image formed product without wrinkles can be created.

As described above, the invention made by the present inventor has been specifically described based on the embodiment. However, the present invention is not limited to the above-described embodiment, and changes can be made without departing from the gist of the invention.

For example, in the embodiment, one of the first loop roller section 31A and the second loop roller section 31B, the one having a higher conveying speed at the time of the skew correction, is moved to remove the loop distortion. However, the other may be moved, or both of them may be moved. Further, only one of the first loop roller section 31A and the second loop roller section 31B may be made movable in the sheet width direction.

Further, in the first loop roller section 31A or the second loop roller section 31B, only one of the drive rollers 311A and 311B, or one of the driven rollers 312A and 312B, having a higher friction coefficient (typically, a drive roller made of rubber), may be moved.

Further, the present invention can be applied not only to the sheet conveying section in the image forming apparatus, but also to a sheet conveying device including the function to correct skew of a sheet with two skew correction roller sections that can be independently driven (for example, a sheet conveying section of an external sheet feeding device or sheet discharging device).

Although the present invention has been described and illustrated in detail, it is clearly understood that the same is by way of illustrated and example only and is not to be taken by way of limitation, the scope of the present invention being interpreted by terms of the appended claims, and all of changes within the scope of the appended claims or the equivalents thereof are included.

What is claimed is:

1. A sheet conveying device comprising:

a skew detection section configured to detect a tilt of a sheet to be conveyed;

two skew correction roller sections that are arranged side by side in a sheet width direction and are independently able to be driven;

a downstream-side conveying roller section arranged at a downstream side of at least one of the two skew correction roller sections in a sheet conveying direction; and a control section configured to control conveying operations of the at least one of the two skew correction roller sections based on a detection result of the skew detection section, wherein the at least one of the skew correction roller sections is configured to be movable in the sheet width direction, and the control section moves at the least one of the skew correction roller sections outward in the sheet width direction at predetermined timing, wherein the downstream-side conveying roller section is a registration roller section that stops conveyance of the sheet once in a state where a tip of the sheet butts against a nip of the downstream-side conveying roller section to adjust send timing, and the control section moves the skew correction roller section outward in the sheet width direction, after bending of the sheet is formed between the at least one of the skew correction roller sections and the registration roller section.

2. The sheet conveying device according to claim 1, wherein the control section moves the skew correction roller section outward in the sheet width direction, after a conveying operation of the registration roller section is started.

3. An image forming apparatus comprising:

the sheet conveying device according to claim 1; and an image forming section configured to form an image on a sheet conveyed by the sheet conveying device.

4. A sheet conveying device comprising:

a skew detection section configured to detect a tilt of a sheet to be conveyed;

two skew correction roller sections that are arranged side by side in a sheet width direction and are independently able to be driven;

a downstream-side conveying roller section arranged at a downstream side of at least one of the two skew correction roller sections in a sheet conveying direction; and a control section configured to control conveying operations of the at least one of the two skew correction roller sections based on a detection result of the skew detection section, wherein the at least one of the two skew correction roller sections is configured to be movable in the sheet width direction such that an interval between the two skew correction roller sections in the sheet width direction widens, and the control section moves the at least one of the skew correction roller sections outward in the sheet width direction at predetermined timing during conveyance of the sheet;

wherein the control section stops the two skew correction roller sections when a tip of the sheet reaches the downstream-side conveying roller section and bending is formed in the sheet, and moves at least one of the skew correction roller sections outward in the sheet width direction when the conveyance of the sheet by the downstream-side conveying roller section is restarted.

5. The sheet conveying device according to claim 4, wherein the control section puts the skew correction roller section back to an original state by a time when a next sheet enters after the sheet passes through the at least one of the two skew correction roller sections.

6. The sheet conveying device according to claim 4, wherein the skew correction roller section is moved in the sheet width direction by power of a drive motor transmitted thereto through a track and pinion mechanism.

7. The sheet conveying device according to claim 4, wherein the skew correction roller section is moved in the sheet width direction by cooperation of a solenoid and an elastic member.

8. The sheet conveying device according to claim 4, wherein the at least one of the two skew correction roller sections include a drive roller and a driven roller, and the drive roller and the driven roller are integrally moved.

9. The sheet conveying device according to claim 4, wherein the at least one of the two skew correction roller sections include a drive roller and a driven roller, and one of the drive roller and the driven roller, the one having a higher friction coefficient, is moved.

10. An image forming apparatus comprising:

the sheet conveying device according to claim 4; and an image forming section configured to form an image on a sheet conveyed by the sheet conveying device.

11. A sheet conveying device comprising:

a skew detection section configured to detect a tilt of a sheet to be conveyed;

two skew correction roller sections that are arranged side by side in a sheet width direction and are independently able to be driven;

a downstream-side conveying roller section arranged at a downstream side of the at least one of the two skew correction roller sections in a sheet conveying direction; and a control section configured to control conveying operations of the at least one of the two skew correction roller sections based on a detection result of the skew detection section, wherein the at least one of the two skew correction roller sections is configured to be movable in the sheet width direction such that an interval between the two skew correction roller sections in the sheet width direction widens, the control section moves the at least one of the skew correction roller sections outward in the sheet width direction at predetermined timing, and wherein the control section determines a moving amount of the skew correction roller section based on a sheet condition and a detection result of the skew detection section.

* * * * *